US007036480B2

(12) United States Patent
Williams et al.

(10) Patent No.: US 7,036,480 B2
(45) Date of Patent: May 2, 2006

(54) ENGINE LUBRICATION SYSTEM

(75) Inventors: David John Williams, Warwick (GB); David Thomas Black, Birmingham (GB)

(73) Assignee: Dana Automotive Limited, (GB)

( * ) Notice: Subject to any disclaimer, the term of this patent is extended or adjusted under 35 U.S.C. 154(b) by 45 days.

(21) Appl. No.: 10/428,680

(22) Filed: May 2, 2003

(65) Prior Publication Data

US 2004/0031463 A1 Feb. 19, 2004

(30) Foreign Application Priority Data

May 15, 2002 (GB) ..... 0211035

(51) Int. Cl.
*F01M 1/00* (2006.01)

(52) U.S. Cl. ..... 123/196 S; 123/196 R

(58) Field of Classification Search ..... 123/196 R, 123/196 S, 196 AB; 184/6.4, 6.8, 27.2
See application file for complete search history.

(56) References Cited

U.S. PATENT DOCUMENTS 3,973,398 A 8/1976 Kittle
4,329,952 A * 5/1982 Buraas ..... 123/196 AB
4,458,644 A 7/1984 Pabst
5,159,910 A * 11/1992 Ninomiya et al. .... 123/196 AB
5,220,891 A * 6/1993 Nakamura et al. ..... 123/90.16
5,339,776 A * 8/1994 Regueiro ..... 123/196 CP
5,743,231 A 4/1998 Reinosa
5,884,601 A * 3/1999 Robinson ..... 123/196 S
5,964,318 A * 10/1999 Boyle et al. ..... 184/1.5
5,980,340 A * 11/1999 Okamoto ..... 440/88 L
6,202,790 B1 3/2001 Oligmueller
6,269,788 B1 8/2001 Kachelek
6,575,018 B1 * 6/2003 Berndorfer et al. ..... 73/54.01
6,750,763 B1 * 6/2004 Ismail et al. ..... 340/450.3

FOREIGN PATENT DOCUMENTS

CH 652 454 A5 11/1985
EP 0 750 099 A2 12/1996
GB 2042649 9/1980

* cited by examiner

*Primary Examiner*—Henry C. Yuen
*Assistant Examiner*—Hyder Ali
(74) *Attorney, Agent, or Firm*—Dykema Gossett PLLC

(57) ABSTRACT

A lubrication system for an engine includes a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller selectively to divert at least a proportion of the lubricant from the lubricant feed line to the lubricant conditioner.

13 Claims, 1 Drawing Sheet

ENGINE LUBRICATION SYSTEM

This application claims priority to United Kingdom Patent Application No. 0211035.1 filed May 15, 2002, the entire disclosure of which is incorporated herein by reference.

FIELD OF INVENTION

This invention relates to an engine lubrication system and to a method of operating such a system.

DESCRIPTION OF PRIOR ART

Conventionally engine lubrication systems include a mechanically driven lubrication pump, the output of which is solely dependent upon the engine speed. In steady conditions and at lower engine speeds such mechanical pumps work well and efficiently. However at higher engine speeds, such mechanical pumps tend to pump lubricant in excess of that which is required for lubrication, making them inefficient, and in non-steady conditions, for example when the engine is operating at low speed under heavy load, it is possible that adequate lubrication will not be provided.

Accordingly it has previously been proposed to utilise an electrically driven lubrication pump, the output of which can be varied intelligently to match engine operating conditions. However a straight replacement of the conventional mechanically driven pump with an electrically driven pump only overcomes some of the deficiencies of using conventional mechanically driven pumps.

SUMMARY OF THE INVENTION

According to one aspect of the invention we provide a lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller selectively to divert at least a proportion of the lubricant from the lubricant feed line to the lubricant conditioner.

It will be appreciated that when using a conventional mechanically driven pump, a mechanically operated by-pass for lubricant is required because the lubricant pressure and volume pumped is solely dependent upon engine speed, and thus it is not possible to divert a significant proportion of the pumped lubricant into a lubricant conditioner without compromising the operation of the by-pass and hence compromising the lubricant supply to the engine. In accordance with the invention though, where an electrically driven pump is provided, no such by-pass is required as the pump speed is not solely dependant upon the engine speed such that the pump output can be reduced where excess pressure/volume of lubricant is being pumped.

The lubricant conditioner may include at least one of a lubricant cooler and a lubricant filter.

Thus for example when it is desired to allow the lubricant to become heated, e.g. upon engine start-up, and the lubricant conditioner includes a lubricant cooler, the controller may operate the diverter valve so that no or only a small proportion of the lubricant is diverted to the lubricant cooler so that the lubricant becomes heated towards a desired operating temperature more quickly.

Alternatively or additionally, where the lubricant conditioner includes a filter, as the filter becomes clogged with filtered particulates, the lubrication system controller may operate the diverter valve so that no or only a small proportion of lubricant is diverted to the lubricant filter, in order to maintain the lubricant pumped pressure in the system.

Where the lubrication conditioner includes a filter, to assess the extent of blockage of the filter, the lubrication conditioner may be provided in a diverted lubricant circuit and a lubricant pressure sensor may be provided in the diverted lubricant circuit to determine lubricant pressure in the circuit. Such a sensor may include a pair of pressure transducers, one either side of the filter in the diverted lubricant circuit.

The lubricant pressure sensor may provide an input to the controller which operates the diverter valve appropriately in response. The system may include a warning device, e.g. operated by the controller, to indicate to a driver that the filter of the lubricant conditioner is clogged to an unacceptable condition.

Where the lubricant conditioner includes an lubricant filter, this may be a fine filter, and another, e.g. coarser, filter may be provided in the lubricant feed line, so that even where little or no lubricant is diverted into the lubricant conditioner, the lubricant is filtered.

Of course if desired, the proportion of lubricant diverted to the lubricant conditioner may be adjusted by the controller operating the diverted valve depending on the lubrication requirements of the engine.

Preferably the pump speed is variable under the control of the controller and the controller may thus adjust the pump speed depending upon engine operating conditions, as well as the position of the diverter valve, to achieve a desired lubricant flow to the lubrication points for the engine conditions.

In a preferred example, the diverter valve includes a drive motor which includes a feedback device to feed back to the controller information relating to the extent of opening of the diverter valve, whereby the motor is operated by the controller to achieve a desired proportion of lubricant to be diverted.

Preferably the lubrication system controller is provided with further inputs which are used by the controller to determine an appropriate lubrication strategy, namely pump speed and proportion of lubricant to be diverted to the lubricant conditioner.

For one example where the lubricant conditioner includes a lubricant cooler and the engine includes a heat operated device, such as a device in the engine exhaust system which burns particulates in the engine exhaust gases, one input to the lubrication system controller may indicate a level of clogging of a particulate filter or another sensed or measured parameter in response to which the diverter valve may be operated to reduce or stem altogether the proportion of lubricant which is diverted to the lubricant conditioner, so that the lubricant temperature and thus the engine temperature and thus the temperature of the exhaust gases is increased in order to cause the particulates to be burned.

In another example an input to the lubrication system controller may be indicative of a particular driver's driving habits, so that an appropriate lubrication strategy is determined by the controller for a particular driver. The input may be derived in real time by a driver monitor, and/or may be derived from a driver profile previously determined and/or programmed into a memory.

In a further example an input to the lubrication system controller may be indicative of engine wear, the controller altering the lubrication strategy to compensate for engine wear. Such input may be derived from feedback pressure sensors and a comparitor device which compares actual lubricant pressure at selected positions within the engine, with expected lubricant pressure for the engine operating conditions and actual lubrication strategy. Thus for example, to maintain a certain lubricant pressure, the lubricant pump may be operated to pump faster as the engine wears.

In yet another example, an engine load sensor may provide an input to the lubrication system controller which adjusts the lubrication strategy depending on engine load. The sensor may for example sense the load imposed by the passengers and luggage etc., and/or the load imposed by a trailer or the like when coupled to a vehicle in which the engine is provided.

The engine typically would include a main lubricant gallery from which lubricant passes to lubrication positions to lubricate bearings and other components of the engine crankshaft, and a secondary gallery from which lubricant passes to lubrication positions to lubricate and seal the undersides of pistons of the engine, as well as a head gallery from which lubricant passes to lubrication positions to lubricate and perhaps actuate engine valve operating devices, such as an engine camshaft, and/or a variable timing device and/or hydraulically operated lash adjusters and/or where the engine is a camless engine, electrically or hydraulically operated engine valves.

Where a secondary gallery for lubricant to lubricate and cool the undersides of the pistons is provided, such lubrication may not be required for all engine operating conditions. Accordingly, preferably a control valve is provide which may be operated by the lubrication system controller to allow lubricant to flow to the secondary gallery in selected operating conditions, such as for example, when the engine speed and/or load and/or temperature exceeds a predetermined level.

According to a second aspect of the invention we provide a method of operating a lubrication system including for an engine which includes a sump for lubricant, a pump to pump lubricant along a lubricant feed line to lubrication positions within the engine, and a lubricant conditioner, and wherein the pump is an electrically driven pump, the method including controlling the lubricant pump and a diverter valve selectively to divert at least a proportion of the lubricant from the lubricant feed line to the lubricant conditioner.

The system may have any of the features of the system of the first aspect of the invention.

According to a third aspect of the invention we provide a method of removing lubricant from a lubrication system of an engine where the engine includes a sump for lubricant, an electrically driven pump to pump lubricant along a lubricant feed line to lubrication positions within the engine, there being a diverter valve selectively to divert at least a proportion of the lubricant from the lubricant feed line to an outlet, the method including diverting the lubricant to the outlet.

Thus using the method of the third aspect of the invention, worn and/or contaminated lubricant may more easily be removed from the engine by operating the pump. By virtue of the pump being electrically operated, the engine need not be operated in order to pump the lubricant as with a mechanically driven pump.

The diverter valve may be a simple closer device to which a coupling may be made e.g. into the lubrication pump.

According to a fourth aspect of the invention we provide a diverter valve which includes an inlet and first and second outlets, and a valve member which is rotatable between a first position in which the inlet communicates with the first outlet and the second outlet is isolated, and a second position in which the inlet communicates with the second outlet and the first outlet is isolated, the valve member being in the form of a ball with passages within the ball which open at mouths to a circumferential surface of the ball, to provide the inlet and first and second outlets, one or more of the mouths being configured such that between the first and second positions, the inlet communicates with each of the first and second outlets to an extent dependent upon the rotational position of the ball.

The diverter valve of the fourth aspect of the invention may be a diverter valve for use in the invention according to the first and/or second and/or third aspects of the invention.

According to a fifth aspect of the invention we provide an engine including a lubrication system according to the first aspect of the invention.

According to a sixth aspect of the invention we provide a lubricant sump for an engine, the sump including a first integral mounting for an electrically driven lubrication pump, a second integral mounting for a lubrication conditioner to which at least a proportion of pumped lubricant may be selected to be diverted by a diverter valve, and a third integral mounting for the diverter valve, the sump including at least part of a lubricant feed line for pumped lubricant from the pump, in which is provided the diverter valve.

DESCRIPTION OF THE DRAWINGS

Embodiments of the invention will now be described with reference to the accompanying drawings in which.

DESCRIPTION OF THE PREFERRED EMBODIMENTS OF THE INVENTION

Figures 1, 2:
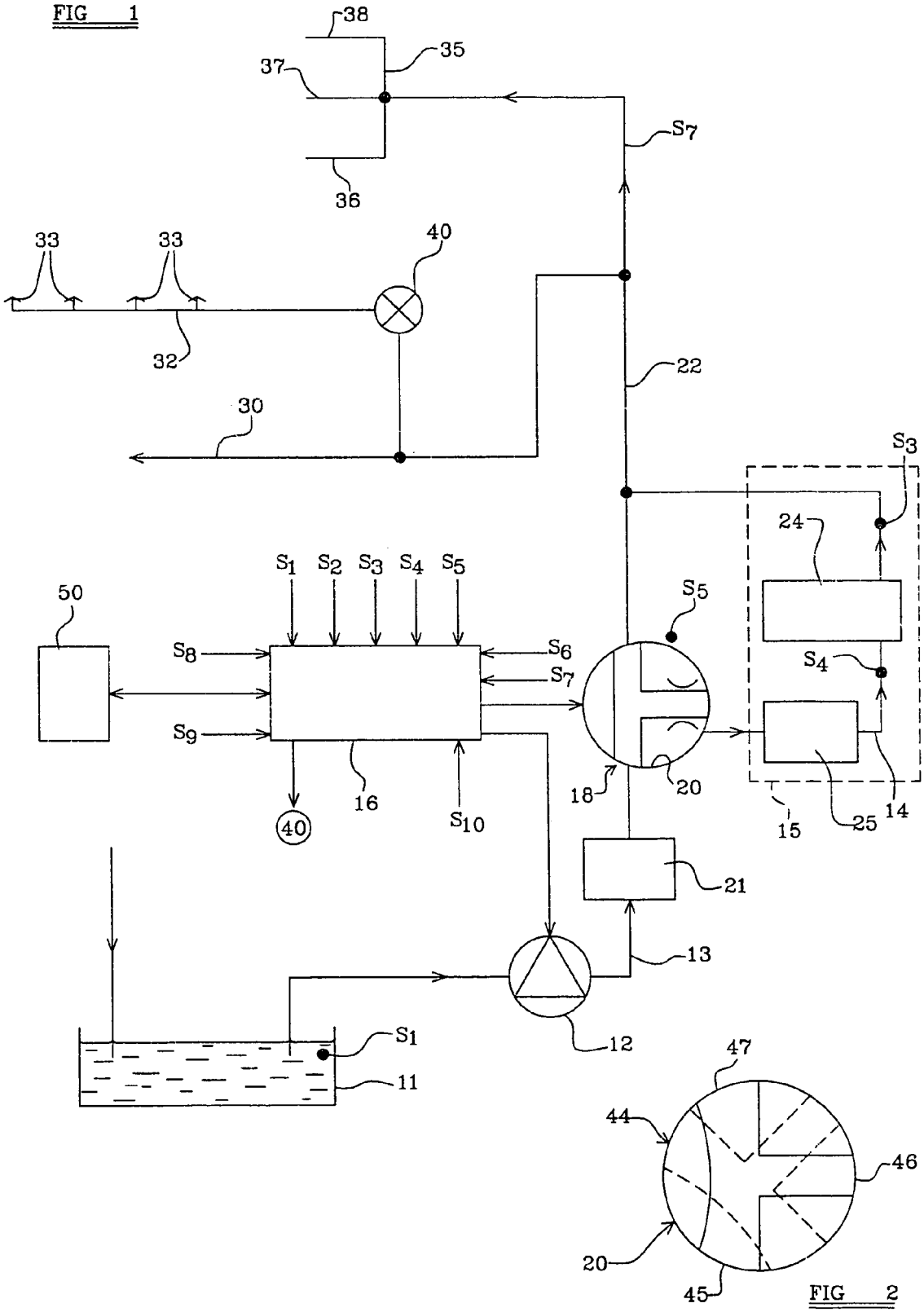
FIG. 1 is an illustrative diagram of a lubrication system in accordance with the invention.
FIG. 2 is an illustrative view of a valve member of a diverter valve for use in the system of FIG. 1.

Referring to FIG. 1 of the drawings there is shown a lubrication system 10 for an engine. The system 10 includes a sump 11 for lubricant, a pump 12 to pump lubricant along a lubricant feed line 13 to various lubrication positions within the engine, and a lubricant conditioner 15.

The pump 12 is an electrically driven pump, such as a brushless D.C. pump, which is controlled by a system controller 16 which may be a dedicated lubrication system controller as shown, or may be integrated entirely or in part with a general engine management system or into the pump 12 or into a valve, e.g. valve 18 which the controller 16 controls, as desired.

Within the lubrication feed line 13, there is provided a diverter valve 18 which is an electrically driven valve, which includes a valve member 20 which is described in more detail below with reference to FIG. 2, the rotational position of which may be adjusted under the control of the controller 16 selectively to divert at least a proportion of the lubricant from the lubricant feed line 13 into a diverted lubricant circuit 14 where there is a lubricant conditioner 15.

In this example, the lubricant which is pumped by the pump 12 passes through a main filter 21 which filters any larger particulates from the lubricant. As is conventional, the main filter 21 is a relatively coarse filter so as not to impede the flow of lubricant. The finer the filter the more prone the filter is to clogging thus requiring more frequent replacement. Thus the degree of filtering achieved by the main filter 21 necessarily is a compromise.

The lubricant conditioner 15 in this example includes a further filter 24 which may be a finer filter than the main filter 21, but as described below, because all of the lubricant is not constrained to pass through the lubricant conditioner 15, the further filter 24 need not seriously affect the lubricant flow/pressure generally in the engine, even if clogged.

However desirably the main filter 21 and the further filter 24 each have integral by-pass systems to prevent filter blockage preventing the flow of lubricant to the engine.

The lubricant conditioner 15 further includes in this example, a lubricant cooler 25 in which heat in the lubricant may be exchanged with a coolant, such as an engine coolant e.g. water or air, to reduce the lubricant temperature.

Thus depending upon the position of the valve member 20 of the diverter valve 18, the proportion of lubricant which may be diverted into the lubricant conditioner 15 may be varied, by the system controller 16 depending upon many different factors.

In the present example, the engine is of the kind which includes a main gallery 30 in which there is one or more lubrication positions to which the lubricant is delivered by the feed line, to lubricate the main bearings etc. of the engine crankshaft and any turbo charger or other device requiring a supply of lubricant; a secondary gallery 32 in which there are a plurality of lubrication positions, as indicated at 33 for lubricating and achieving cooling of the undersides of pistons of the engine, and a head gallery 35 having lubrication positions, for example as shown at 36 to lubricate the engine camshaft (where provided); and at 37 to provide hydraulic pressure and lubrication to hydraulic lash adjusters; and at 38 to provide lubrication and/or hydraulic pressure for a variable valve timing (VVT) mechanism.

Because under-piston lubrication and cooling may only be required at certain engine speeds, for example at engine speeds above a predetermined speed, a control valve 40, which in this example is solenoid operated under the control of the controller 16, is provided which may be a simple on/off valve or a proportional valve.

The controller 16 may be arranged to provide a lubrication strategy, that is a pump 12 speed and diverter valve 18 position, and the conditions under which the control valve 40 opens/closes, depending on engine operating conditions and other inputs to the controller 16.

Referring to FIG. 2, it can be seen in this example, that the valve member 20 of the diverter valve 15 is a ball with passages in the ball which open at a circumferential surface 44 of the ball, at mouths indicated at 45, 46, and 47. Mouth 45 is shown in the figures providing an inlet, and mouths 46 and 47 respectively, first and second outlets. One or more of the mouths 45, 46, 47 is/are configured so that in a first operating position lubricant may flow from the inlet 45 to the first outlet 46 only, so that all flow is directed to the diverter fluid circuit 14; and in a second operating position lubricant may flow from the inlet to the second outlet 47 only, so that no flow is diverted, but the valve member 20 being movable into positions between the first and second operating positions in which the lubricant flows from the inlet 45 to each of the first and second outlets 46, 47 in proportion depending upon the rotational position of the valve member 20. Thus the diverter valve 18 may in this example be a 180° three-way valve, that is the ball 20 may be rotatable through 180° to achieve the functionality described, in which case one or other of the mouths 46, 47 may in certain valve member 20 positions provide an inlet for pumped lubricant and the mouth 45 an outlet, and/or the mouths 45, 46, 47 being isolated in one or other of the first and second operating positions described.

The rotational position of the diverter valve member 20 is controlled by the controller 16, with for example there being position sensors (S5—see below) to sense the rotational position of the ball 20 in order to provide a feed back input to the controller 16 relating to the valve member 20 position.

The proportion of the lubricant which is diverted to the lubricant conditioner 15 may thus be selected by the controller 16 depending upon engine operating conditions.

Where maximum lubricant flow to the various lubrication positions is required, the diverter valve 18 may only divert a minimal or indeed no lubricant flow to the lubricant conditioner 15. Where a lesser lubricant flow is required, a greater proportion of the pumped lubricant may be diverted to the conditioner 15 to achieve more thorough filtering though the finer secondary filter 24.

Where the lubricant is too hot, a greater proportion of the lubricant may be diverted to the conditioner 15 for cooling in the lubricant cooler 15, and vice versa.

In the event that the secondary fine lubricant filter 24 of the conditioner 15 becomes clogged by filtered particulates, a lesser proportion of the lubricant may be diverted to the conditioner 15. If desired, clogging of the filter 24 beyond an acceptable degree may cause a warning to be given e.g. to a driver, that the filter 24 requires replacement. Additionally or alternatively if desired, a by-pass may be provide within the conditioning circuit 14 so that lubricant may continue to be diverted to the lubricant cooler 25 but not to the clogged secondary filter 24.

It will be appreciated that the lubrication strategy will be different for different engines and thus if desired a look-up table 50 with various mapped data relating to a particular engine configuration may be provided, such data being obtained as a result of empirical and/or theoretical test data for a particular engine. However the lubrication strategy may also be dynamic so as to be determined with reference to sensed conditions.

In the present example, the temperature of the lubricant in the sump 11 may be determined by a temperature sensor, indicated at S1, the sensor S1 thus providing an input to the controller 16.

The lubricant pressure either side of the secondary filter 24 may be sensed by a pressure sensor provided by a pair of pressure transducers S2 and S3 which may again provide inputs to the controller 16, and the position sensors S5 of the diverter valve 18 may provide yet further inputs to the controller 16. An engine speed sensor S6 may provide another input to the controller 16 relating to engine speed or such information may be provided from the engine management system, for example information relating to engine load, throttle position, or other overriding instructions from the engine management system.

From each of these inputs and the data in the look-up table 50, the controller may, according to an algorithm, adjust the speed of the electrically driven lubrication pump 12, and the position of the diverter valve 18 and control valve 40 to achieve a desired lubrication strategy.

Other inputs may be provided to the controller 16, for example inputs from further lubricant pressure sensors S7 adjacent the head gallery 35 and/or from the VVT device etc., which may call for more lubricant to be pumped under certain operating conditions.

An input S8 may be provided to the controller which is indicative of the work being performed by the engine, for example as a result of loads in the vehicle in which the engine is provided, or a trailer of the like to which the vehicle is coupled. Indeed when a trailer of the like is coupled, a sensor may provide an input S8. An indication as to the work being performed by the engine may also be obtained by relating the accelerator position to the engine speed, and this functionality is already provided by some engine management systems.

An input S9 may be provided to the controller 16, for example from an engine management system, indicative of the driver's driving habits so that a suitable lubrication strategy for an individual driver, for example for a more aggressive or less aggressive driver, may be designed, or a strategy which is more suited to predominantly motorway or urban type driving may be designed. Such data may be derived dynamically and/or a particular driver profile may be built up from historical data.

The controller 16 may thus operate the lubrication system 10 as follows.

To provide for priming of the lubrication system 10 prior to engine startup, the pump 12 may be operated for at least a few seconds before the engine can be started. In the event that the lubricant temperature is sensed to be below a minimum temperature (say 0° C.) an electrical lubricant heater may be operated. In this priming mode, the diverter valve 18 may divert no or only a minimal proportion of the lubricant to the lubricant conditioner 15, so that the lubricant does not pass to the lubricant cooler 25.

When the engine is started, the controller 16 may divert more lubricant to the conditioner 15 as the lubricant warms, and depending upon the engine speed.

In the event that the engine labours (S8 input), for example as the vehicle travels uphill, an increased volume of lubricant may be provided by the pump 12.

When the engine speed and/or load and/or temperature exceeds a predetermined speed, the control valve 40 may be opened to achieve under-piston lubrication and cooling.

In the event that the pressure transducers S3 and S4 indicate that the secondary fine filter 24 is clogged, the controller 16 may increase the pump 12 speed whilst maintaining the same proportion of lubricant diversion to the conditioner 15 (for example if the same degree of lubricant cooling is desired) and/or may divert less lubricant to the conditioner 15.

If the various pressure sensors of the system indicate that for certain conditions the active lubricant pressure is less than expected, this may indicate engine and/or pump 12 wear, in which case the controller 16 may be arranged to pump more lubricant to compensate. Thus the pressure sensors' output may be compared in a comparator device of the controller 16 with data relating to an expected pressure for given engine operating conditions.

When the engine is switched off, the pump 12 may be arranged to continue to operate for a short period, while for example a flywheel of a turbocharger device which is driven from the-exhaust gases, continues to rotate, so that the rotating turbocharger continues to be lubricated. Also, where the operation of the lubrication system 10 is coordinated with the engine cooling system, lubricant may continue to be cooled where diverted to the lubricant cooler 21.

Desirably, the sump 11 includes integral mountings for the pump 12, the diverter valve 18, the lubricant conditioner 15, and the main lubricant filter 21 so that the major operating components of the lubrication system 10 are conveniently packaged with minimal interconnecting conduits for the lubricant being required.

Various modifications may be made without departing from the scope of the invention. For example, if desired, a sensor may be provided to sense when the VVT mechanism is operated, to provide another input to the controller 16 which responds by increasing lubricant flow appropriately. Or indeed, the engine management system may send a signal to the lubrication controller 16 giving notice of its intent to operate the VVT mechanism allowing the lubrication system control 16 to prepare the optimum lubrication conditions for subsequent VVT actuation. Otherwise, the lubrication system controller 16 may receive an input from the engine management system relating to the detection of an imminent requirement for lubricant, or of a predicted requirement for lubricant by other lubricant requiring devices.

In another engine, the control valve 40 may not be provided. In another engine VVT may not be employed in which case lubrication points for VVT would not be required, and/or the engine may be camless with engine valves being operated by e.g. electrically operated solenoids, so that lubrication positions adjacent the camshaft would not be required but additional lubrication positions adjacent the electrically operated valves may be required for lubrication and/or actuation purposes.

If desired, where the invention is applied to an engine which has a device in the engine exhaust system which burns particulates in the engine exhaust gases, a yet further input to the lubrication system controller at S10, may indicate a level of clogging of a particulate filter or another sensed or measured perameter in response to which the diverter valve 18 may be operated to reduce or stem altogether the proportion of the lubricant which is diverted to the lubricant conditioner so that the lubricant temperature and thus the engine temperature and thus the temperature of the exhaust gases is increased in order to cause the particulates to be burned and thus the particulate filter to be regenerated. In such a condition, it may be essential to operated valve 40 to allow continual under-piston cooling and lubrication which may otherwise only be actuated on demand.

Instead of the ball valve member 20 type diverter valve 18 described, an alternative valve member, the position of which and hence the extent of diversion of the lubricant to the lubricant conditioner 15, is adjustable by the controller 16 when determining the lubrication strategy, may be employed.

Any suitable kind of electrically driven pump 12 may be provided such as for examples only, a gerotor pump, a ring gear pump or a disc pump.

If desired, the diverter valve 18, or another diverter valve may be provided which may, when the pump 12 is operated, divert lubricant to an outlet from the engine. Preferably the lubricant may be diverted to the outlet when the engine is inoperative. Particularly where the lubricant is warm, the warm lubricant may thus readily flow to the outlet. The diverter valve may be a simple quick connector valve to which a coupling may be made and/or a simple closure. Such a valve may be provided at the lubrication pump 12, or at some other suitable position of the system 10, for example at a connection of the lubrication filter 24 or oil cooler 25 to the system 10. Thus the pump 12 may usefully be employed to remove contaminated/worn lubricant from the engine, and rather than relying on gravity for the lubricant flow to the outlet, the contaminated/worn lubricant may be pumped into a container via a hose or like conduit attached to the outlet.

The invention claimed is:

1. A lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller and which is operable selectively to divert a proportion of the lubricant from the lubricant feed line to the lubricant conditioner wherein the lubrication system controller is provided with inputs which are used by the controller to determine an appropriate lubrication strategy, the lubrication system controller operating the diverter valve and the pump to alter the proportion of lubricant diverted to the lubricant conditioner and the pump speed according to the engine speed, and at least one of:

(i) the temperature of the lubricant;

(ii) where the engine includes a device in the engine exhaust system which burns particulates in the engine exhaust gases, an indication of a level of clogging of the particulate filter;

(iii) an input to the lubrication system controller indicative of a particular driver's driving habits derived in real time by a driver monitor, and/or derived from a driver profile previously determined and/or programmed into a memory from historical data;

(iv) an input indicative of engine wear, derived from feedback pressure sensors and a comparitor device which compares actual lubricant pressure at selected positions within the engine, with expected lubricant pressure for the engine operating conditions and actual lubrication strategy;

(v) an input dependent upon engine load as sensed by an engine load sensor.

2. A system according to claim 1 wherein the lubricant conditioner includes at least one of a lubricant cooler and a lubricant filter.

3. A systems according to claim 2 wherein where the lubricant conditioner includes a lubricant cooler, when it is desired to allow the lubricant to become heated, the controller is arranged to operate the diverter valve so that no or only a small proportion of the lubricant is diverted to the lubricant cooler so that the lubricant becomes heated towards a desired operating temperature more quickly.

4. A system according to claim 1, wherein the sump includes a first integral mounting for the electrically driven lubrication pump, a second integral mounting for the lubricant conditioner, and a third integral mounting for the diverter valve, the sump including at least part of the lubricant feed line for pumped lubricant from the pump, in which is provided the diverter valve.

5. A lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller selectively to divert at least a proportion of the lubricant from the lubricant feed line to the lubricant conditioner, wherein the lubricant conditioner includes at least one of a lubricant cooler and a lubricant filter wherein where the lubricant conditioner includes a filter, as the filter becomes clogged with filtered particulates, the lubricant system controller operates the diverter valve so that no or only a smaller proportion of lubricant is diverted to the lubricant filter, in order to maintain the lubricant pumped pressure in the system.

6. A system according to claim 5 wherein to assess the extent of blockage of the filter, the lubrication conditioner is provided in a diverted lubricant circuit and a lubricant pressure sensor is provided in the diverted lubricant circuit to determine lubricant pressure in the circuit.

7. A system according to claim 6 wherein the sensor includes a pair of pressure transducers, one either side of the filter in the diverted lubricant circuit.

8. A system according to claim 5 wherein the system includes a warning device, to indicate that the filter of the lubricant conditioner is clogged to an unacceptable condition.

9. A lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller selectively to divert at least a proportion of the lubricant from the lubricant feed line to the lubricant conditioner wherein the lubricant conditioner includes an lubricant filter which is finer than another filter provided in the lubricant feed line.

10. A lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller selectively to divert at least a proportion of the lubricant from the lubricant feed line to the lubricant conditioner, the engine including a main lubricant gallery from which lubricant passes to lubrication positions to lubricate bearings of the engine crankshaft, a head gallery from which lubricant passes to lubrication points to lubricate engine valve operating devices, a secondary lubrication gallery from which lubricant passes to lubrication positions to lubricate and cool the undersides of pistons of the engine wherein a control valve is provided which is selectively operated by the lubrication system controller to control lubricant flow exclusively to the secondary gallery in selected operating conditions.

11. A lubrication system for an engine including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller and which is operable selectively to divert a proportion of the lubricant from the lubricant feed line to the lubricant conditioner wherein the diverter valve includes a drive motor which includes a feedback device to feed back to the controller information relating to the extent of opening of the diverter valve, whereby the motor is operated by the controller to achieve a desired proportion of lubricant to be diverted.

12. A method of operating a lubrication system for an engine which includes a sump for lubricant, a pump to pump lubricant along a lubricant feed line to lubrication positions within the engine, and a lubricant conditioner, and wherein the pump is an electrically driven pump which is controlled by a lubrication system controller, the method including controlling the lubricant pump and a diverter valve selectively to divert a proportion of the lubricant from the lubricant feed line to the lubricant conditioner wherein the lubrication system controller is provided with inputs which are used by the controller to determine an appropriate lubrication strategy, the lubrication system controller operating the diverter valve and the pump to alter the proportion of lubricant diverted to the lubricant conditioner and the pump speed according to the engine speed, and at least one of:

(i) the temperature of the lubricant;

(ii) where the engine includes a device in the engine exhaust system which burns particulates in the engine exhaust gases, an indication of a level of clogging of the particulate filter;

(iii) an input to the lubrication system controller indicative of a particular driver's driving habits derived in real time by a driver monitor, and/or derived from a driver profile previously determined and/or programmed into a memory from historical data;

(iv) an input indicative of engine wear, derived from feedback pressure sensors and a comparitor device which compares actual lubricant pressure at selected positions within the engine, with expected lubricant pressure for the engine operating conditions and actual lubrication strategy;

(v) an input dependent upon engine load as sensed by an engine load sensor.

13. An assembly, comprising:

an engine; and, a lubrication system including a sump for lubricant, a pump to pump lubricant along a lubricant feed line to lubrication positions within the engine, and a lubricant conditioner, and wherein the pump is an electrically driven pump which is controlled by a system controller, there being a diverter valve which is under the control of the controller and which is operable selectively to divert a proportion of the lubricant from the lubricant feed line to the lubricant conditioner wherein the lubrication system controller is provided with inputs which are used by the controller to determine an appropriate lubrication strategy, the lubrication system controller operating the diverter valve and the pump to alter the proportion of lubricant diverted to the lubricant conditioner and the pump speed according to the engine speed, and at least one of:

(i) the temperature of the lubricant;

(ii) where the engine includes a device in the engine exhaust system which burns particulates in the engine exhaust gases, an indication of a level of clogging of the particulate filter;

(iii) an input to the lubrication system controller indicative of a particular driver's driving habits derived in real time by a driver monitor, and/or derived from a driver profile previously determined and/or programmed into a memory from historical data;

(iv) an input indicative of engine wear, derived from feedback pressure sensors and a comparitor device which compares actual lubricant pressure at selected positions within the engine, with expected lubricant pressure for the engine operating conditions and actual lubrication strategy;

(v) an input dependent upon engine load as sensed by an engine load sensor.

* * * * *

UNITED STATES PATENT AND TRADEMARK OFFICE

CERTIFICATE OF CORRECTION

PATENT NO. : 7,036,480 B2
APPLICATION NO. : 10/428680
DATED : May 2, 2006
INVENTOR(S) : David John Williams and David Thomas Black It is certified that error appears in the above-identified patent and that said Letters Patent is hereby corrected as shown below:

Claim 8, line 4, replace “5” with --7--.

Signed and Sealed this

Twelfth Day of December, 2006

JON W. DUDAS
*Director of the United States Patent and Trademark Office*